United States Patent [19]

Gregory et al.

[11] 4,432,420

[45] Feb. 21, 1984

[54] RISER TENSIONER SAFETY SYSTEM

[75] Inventors: Edward W. Gregory, Calgary, Canada; Gregory G. Baer, Newton, N.C.

[73] Assignee: Exxon Production Research Co., Houston, Tex.

[21] Appl. No.: 290,553

[22] Filed: Aug. 6, 1981

[51] Int. Cl.[3] ..... E21B 34/04

[52] U.S. Cl. ..... 166/355; 60/403; 60/415; 175/5

[58] Field of Search ..... 166/355; 175/5, 6, 7; 254/277, 392; 60/403, 415, 416

[56] References Cited

U.S. PATENT DOCUMENTS

| | | | |
|---|---|---|---|
| 3,032,125 | 5/1962 | Hiser et al. | 166/355 |
| 3,426,843 | 2/1969 | Visser | 166/355 |
| 3,601,187 | 8/1971 | Tidwell | 175/7 |
| 3,714,995 | 2/1973 | Hanes et al. | 175/5 |
| 3,718,316 | 2/1973 | Larralde et al. | 175/5 |
| 3,804,183 | 4/1974 | Durcan et al. | 175/5 |
| 3,897,045 | 7/1975 | Butler | 175/5 |
| 4,004,532 | 1/1977 | Reynolds | 175/5 |
| 4,049,239 | 9/1977 | Howell | 166/355 |
| 4,085,509 | 4/1978 | Bell et al. | 175/7 |
| 4,121,806 | 8/1978 | Iato et al. | 166/355 |
| 4,222,341 | 9/1980 | Larsen et al. | 175/5 |
| 4,272,059 | 6/1981 | Noerager et al. | 254/392 |

OTHER PUBLICATIONS

"A Primer of Offshore Operations" Petroleum Extension Service, The University of Texas at Austin, 1976.

"The Technology of Offshore Drilling, Completion and Production", The Petroleum Publishing Company, 1976.

Harris, L. P., "Design for Reliability in Deepwater Floating Drilling Operations", 1979.

*Primary Examiner*—Stephen J. Novosad
*Assistant Examiner*—William P. Neuder
*Attorney, Agent, or Firm*—Keith A. Bell

[57] ABSTRACT

A riser tensioner safety system for preventing damage to a floating drilling vessel in a broken cable event or an emergency disconnect of the riser is disclosed. The system uses standard pneumatic/hydraulic tensioning devices together with a safety valve which is installed in the hydraulic fluid supply line to the tensioning device. The valve is held open by tension in the riser tensioner lines. If tension drops below a predetermined level due to a broken cable event or an emergency disconnect of the riser, the valve closes rapidly preventing acceleration of the tensioner piston.

17 Claims, 3 Drawing Figures

RISER TENSIONER SAFETY SYSTEM

FIELD OF THE INVENTION

The present invention relates to a riser tensioner safety system for use in conducting floating drilling operations. More particularly, the invention pertains to a safety system which is triggered by a loss of tension in the tensioner cables thereby preventing damage to the floating drilling equipment.

BACKGROUND OF THE INVENTION

In recent years the search for oil and gas has moved offshore. Early offshore oil wells were drilled from fixed, bottom-founded structures. Subsequently, methods and apparatus were developed for conducting floating drilling operations. Today, most offshore exploration wells are drilled from floating drill ships. Additionally, deep water production wells are likely to be drilled from floating vessels or structures.

In floating drilling operations a marine riser is used to guide the drill string into the well and to provide a path for conducting the drilling fluid back to the vessel. The riser is connected at its lower end to the blowout preventer located at the subsea wellhead and at its upper end to the drilling vessel. Since the drilling vessel is subject to vertical movement due to the action of waves and tides, a vertically extensible slip joint is placed in the upper end of the riser string to accommodate the vessel's vertical motion. As the drilling vessel heaves, the slip joint telescopes to compensate for the vessel movement.

The riser can buckle under the influence of its own weight and the weight of the drilling fluid contained therein if adequate vertical tension is not maintained at its top. Typically, this is provided by using tensioning devices loctated on the drilling vessel to apply axial tension to the upper end of the riser. The tensioning devices are connected to the lower portion of the slip joint. In this manner the vessel is allowed to freely move up and down while maintaining a relatively constant tension in the riser.

Marine risers have been tensioned in various manners including the use of counterweight systems and pneumatic spring systems. The counterweight was the first technique utilized to apply tension to the top of the marine riser. The weight was hung from a wire rope which was reeved up over wire rope sheaves and down to the top of the riser pipe. The tension was equal to the counterweight and therefore was practical only for shallow water drilling where the amount of tension required is low. A second disadvantage of counterweight systems was that large inertial loads were developed when the vessel's movement was large. The pneumatic spring tensioner systems replaced the counterweight systems as deeper and rougher water drilling evolved. The pneumatic spring tensioning devices use a large volume of compressed air to apply nearly constant tension to the top of the riser through wire ropes. See, Harris, L. P., *Design for Reliability in Deepwater Floating Drilling Operations,* Chapter 14, "Marine Riser Tensioning System", pages 188–194, The Petroleum Publishing Company, Tulsa, Okla., 1979.

Nearly, all floating drilling vessels are now equipped with pneumatic/hydraulic tensioning systems. A large air supply keeps a nearly constant pressure above oil in an air-oil accumulator cylinder. The oil then provides pressure to the face of the piston. As the vessel heaves, the piston moves up and down against a relatively constant force and the tension lines maintain a relatively constant pull on the riser. A series of sheaves are provided on the tensioner and the reeving typically used will give a piston stroke of about $\frac{1}{4}$ of the vessel heave.

The tensioner lines are normally run over fixed sheaves supported from the drilling vessel substructure and attached to a tension ring near the top of the outer barrel of the riser slip joint. An even number of tensioners are generally employed and the lines are equally loaded with opposing pairs on opposite sides of the outer barrel. The angles between the tensioner lines and the riser are minimized by locating the turndown sheaves as close to the axis of the riser as possible so that the maximum vertical tension can be applied to the riser.

One disadvantage of present tensioner systems is that the tensioning lines occasionally fail under high tension. Failure is generally attributed to fatigue caused by continuously bending the wire cable back and forth over the sheaves. When the wire cable fails the unrestrained tensioner piston tends to extend rapidly. Since the force behind the piston is generally very high, this unrestrained movement is likely to cause damage to the tensioning device and potentially to the vessel itself. Past efforts to prevent damage from a broken cable event have included the use of flow limiting valves in the tensioner's hydraulic fluid supply line and orifice plates in the exhaust line to limit the final velocity of the piston. Unfortunately, use of these devices also tends to reduce the efficiency of the tensioning system during periods of normal operation.

A second disadvantage of present tensioner systems occurs in the event of an emergency disconnect of the riser. The drilling vessel may move off station due to the action of wind, waves and currents. Alternatively, the automatic positioning system of a dynamically positioned vessel may fail causing the vessel to move laterally. This lateral movement may cause one or more damaging events. For example, the slip joint may contact the vessel's moonpool or may over extend. Also, the riser's lower ball joint may hit its stop. Typically, risers are equipped with a system which allows rapid uncoupling of the riser from the blowout preventer. This uncoupling sharply reduces the tension in the tensioning lines. In such an emergency situation there is not always time to relieve the pressure in the tensioning system. If the riser is disconnected while the tensioning system is still pressurized, the unrestrained riser will be accelerated rapidly upwardly by the tensioning system causing damage to the drilling rig and the vessel. Flow limiting valves and orifice plates partially solve this problem, however, these devices do not completely arrest the riser's upward motion. Also, as noted above, such devices adversely effect the operating efficiency of the tensioning system during normal operation.

Thus, it is apparent that a need exists for a riser tensioner safety system which will prevent damage during a broken cable event or an emergency disconnect of the riser while permitting maximum operating efficiency during periods of normal operation.

SUMMARY OF THE INVENTION

The present invention solves the problems outlined above by providing a riser tensioner safety system which is triggered by a reduction of tension in the tensioner cables below a predetermined level.

The system uses standard pneumatic/hydraulic tensioners to apply force to the tensioner cable. Alternatively, pneumatic spring tensioners, well known in the art, could be used. One end of the tensioner cable is attached to a tension ring located near the top of the outer barrel of the riser slip joint. The other end of the cable is attached to a full opening valve located at the stationary anchor point of the system. The valve is mounted in the hydraulic fluid supply line to the tensioner cylinder and is held open by the tension in the cable. During normal operation the valve stays fully open allowing maximum tensioner operating efficiency. If tension in the cable is lost due to a broken cable event, or sharply reduced due to an emergency disconnect of the riser, the valve closes rapidly stopping the piston.

During normal start up operations, the safety valve is closed preventing fluid flow from reaching the tensioner cylinder. A manually operated valve in a hydraulic line which by-passes the safety valve is used to supply hydraulic fluid to the piston during start up. When the tensioner cable has been tensioned to the point where it will hold the safety valve open, the manually operated valve is closed and all hydraulic fluid supplied to the tensioner must pass through the safety valve.

Any of several different types of valves may be used as a safety valve. It is only important that the valve be capable of being held open by tension in the riser tensioner cable and closed rapidly when tension is lost. The valve may be closed by a mechanical spring, by compressed air or by other known means.

DESCRIPTION OF THE PREFERRED EMBODIMENT

Figure 1:
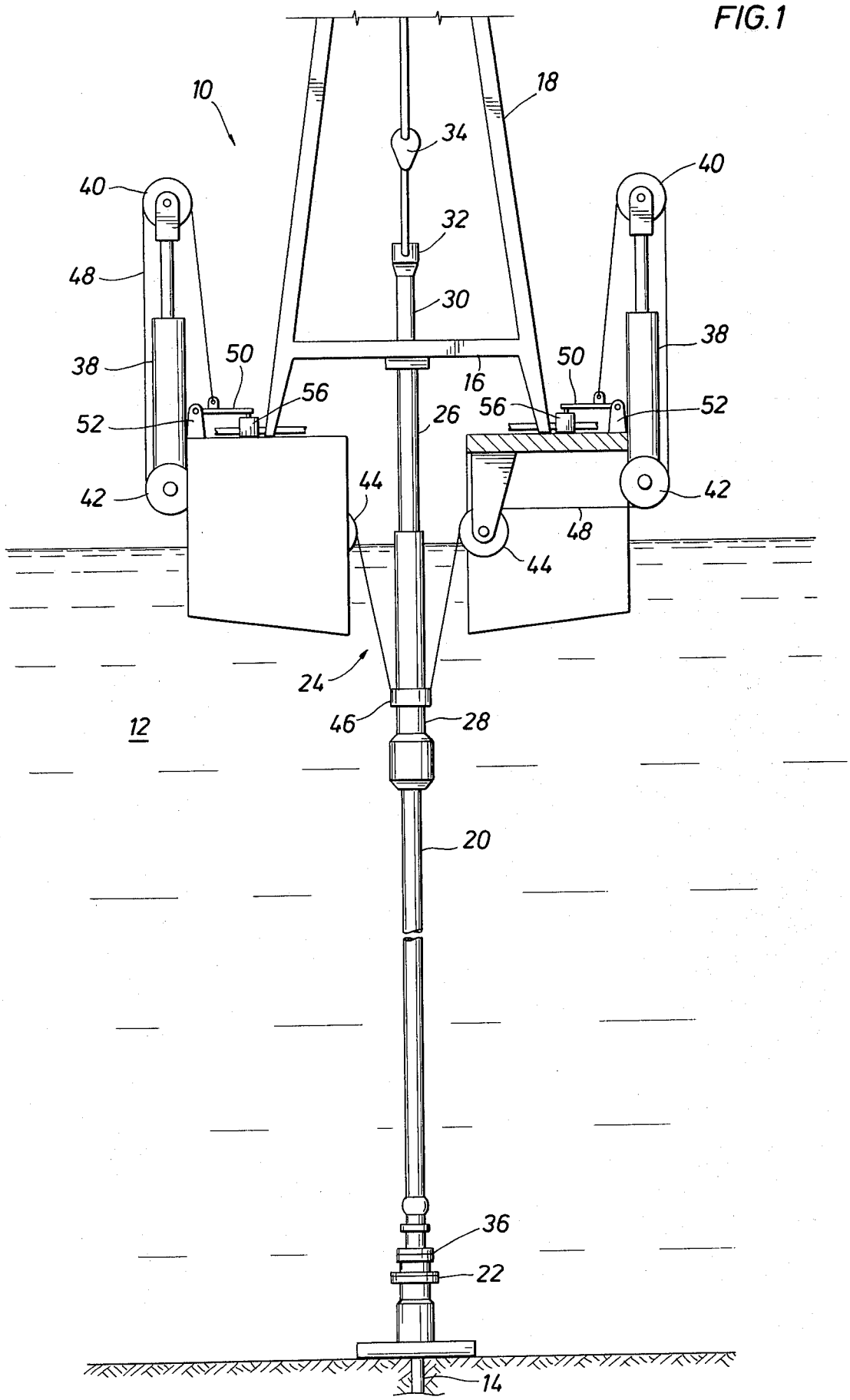
FIG. 1 is an elevational view of a floating drilling vessel which uses the riser tensioner safety system of the present invention.

Referring to FIG. 1, there is shown drilling vessel 10 floating in body of water 12 and engaged in drilling a subsea well 14. The vessel has mounted on its deck a substructure 16 which supports a derrick 18 which includes a drawworks (not shown) and other usual apparatus for conducting floating drilling operations. Extending between the vessel and the wellbore is a marine riser generally indicated at 20 which is connected at its upper end to the substructure 16 and at its lower end to the wellhead through the usual blowout preventer apparatus 22. An emergency disconnect system 36, well known in the art, is installed between the riser 20 and the blowout preventer 22. Typically, the disconnect system would be hydraulically operated. See for example, the disconnect system described at column 6, lines 6–35 of U.S. Pat. No. 3,426,843 to Visser (1969). The marine riser 20 includes a slip joint 24 near its upper end. The slip joint 24 includes an upper cylindrical portion 26 generally referred to as the "inner barrel", which is mounted from and is movable with the vessel 10 and a lower cylindrical portion 28 generally referred to as the "outer barrel", which is attached to the riser 20. The inner barrel 26 telescopes into and out of the outer barrel 28 as the vessel moves vertically relative to the wellbore.

A drill string generally indicated at 30 is supported from a swivel 32 within the derrick. The swivel 32 is suspended from a traveling block 34 which in turn is connected by cables to the crown block (not shown) at the top of the derrick. The drill string extends downwardly through the marine riser 20 into the wellbore 14.

The riser 20 must be supported to prevent it from buckling under the influence of its own weight and the weight of the drilling fluid contained therein. Typically, this is accomplished by using large, pneumatic/hydraulic tensioning devices, well known in the applicable art, to apply an upward axial tension to the top of the riser. See, for example, the discussion of riser tensioning systems in *The Technology of Offshore Drilling, Completion and Production,* Chapter 6, pp. 187–204, Compiled by ETA Offshore Seminars, Inc., The Petroleum Publishing Company, Tulsa, Okla., 1976.

Referring again to FIG. 1, a plurality of tensioning devices 38 are attached to the drilling vessel 10. Tensioning devices 38 may be either pneumatic/hudraulic tensioners or pneumatic spring tensioners. For the remainder of this discussion, it will be assumed that tensioning devices 38 are pneumatic/hydraulic tensioners. Each tensioning device has a movable wire cable sheave 40 attached to the outer end of its piston rod or ram and a stationary wire cable sheave 42 attached to the end of the cylinder body. Additionally, each tensioning device has associated therewith a turndown sheave 44 which is attached to the drilling vessel 10 as close to the horizontal centerline of the riser as possible. A tension ring 46 is mounted near the top of outer barrel 28 of riser slip joint 24. A wire cable or other flexible tensioning line 48 for transmitting tension from the tensioning device 38 to the riser 20 is attached by suitable means to tension ring 46. The cable is then reeved over turndown sheave 44, around stationary sheave 42 and movable sheave 40, and attached by suitable means to valve actuator 50, as will be more fully described below. For clarity, FIG. 1 shows cable 48 reeved once around sheaves 40 and 42. However, in actual practice it is likely that the cable would be reeved a second time around sheaves 40 and 42 prior to being attached to valve actuator 50 so that the necessary piston stroke is only about ¼ of the vessel heave.

Figure 2:
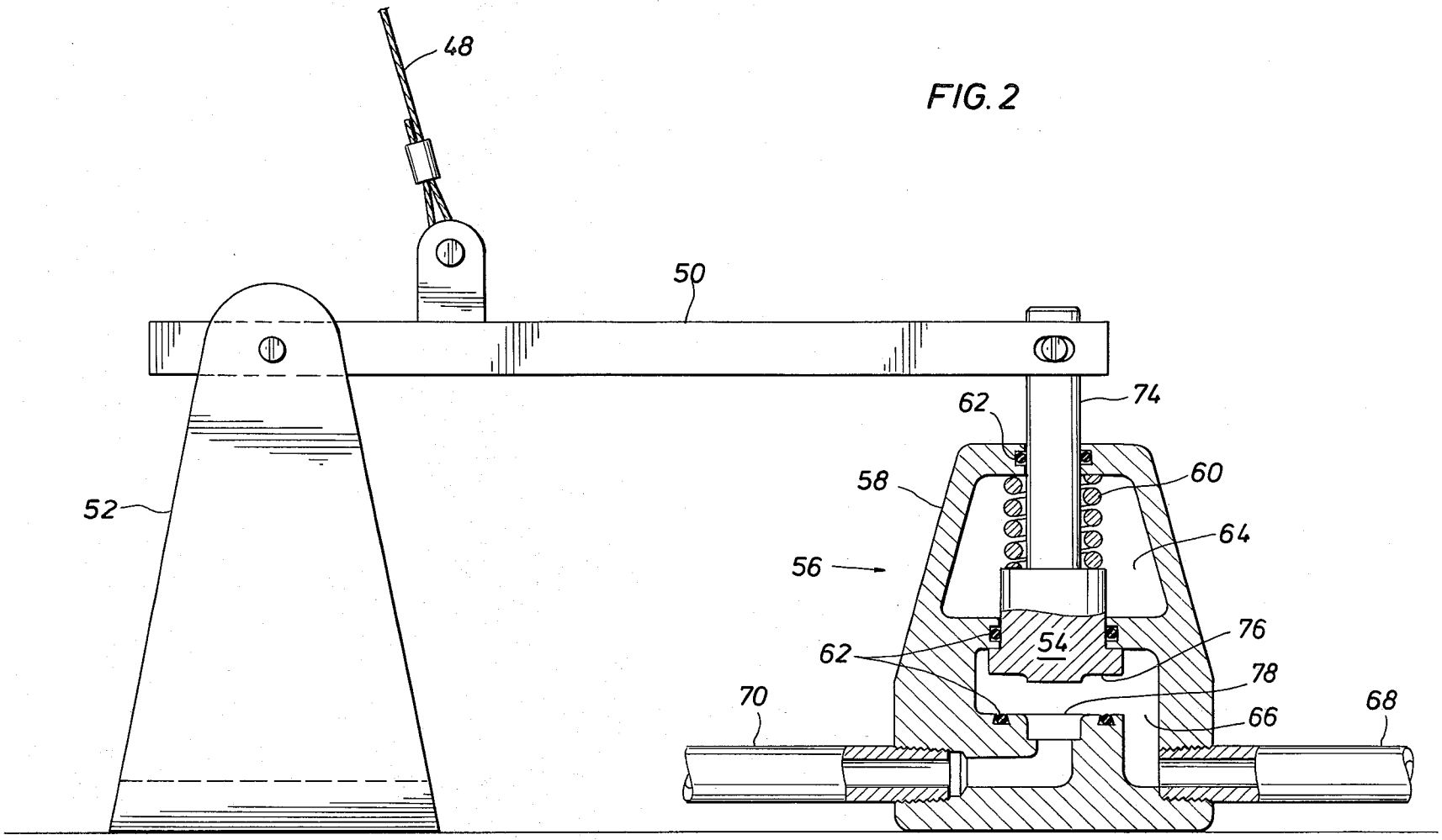
FIG. 2 is an enlarged side view in partial cross section of one embodiment of the safety valve apparatus of the present invention.

As noted above, one end of cable 48 is attached to valve actuator 50. As best shown in FIG. 2, valve actuator 50 is a lever pivotally mounted in a suitable bracket 52. The free end of valve actuator 50 is pivotally attached to the upper end of valve stem 54 which is part of safety valve 56. Tension in cable 48 exerts an upward force on valve actuator 50 which, in turn, exerts an upward force on valve stem 54 thereby holding safety valve 56 open. Other methods of actuating safety valve 56 will be readily apparent to those skilled in the art.

The safety valve depicted in FIG. 2 is a modified globe valve. Other types of valves such as gate valves, needle valves and ball valves could also be used as a safety valve in accordance with the present invention. It is only important that the valve be capable of being held fully open by tension in cable 48 and rapidly closed if tension drops below a predetermined level. The safety valve is installed in the hydraulic fluid supply line (or air pressure supply line if tensioning device 38 is a pneumatic spring tensioner) to tensioning device 38, as will be more fully explained below. The modified globe valve shown in FIG. 2 consists essentially of valve stem 54, housing 58, compression spring 60 and a plurality of O-rings 62 of various sizes which serve to seal the various chambers of the valve. Housing 58 is divided into two separate chambers, upper chamber 64 and lower chamber 66. When the valve is open (as shown in FIG. 2), hydraulic fluid may flow from downstream pipe 68, through lower chamber 66 and into upstream pipe 70. Upstream pipe 70 leads directly to the inlet port of tensioning device 38. Alternatively, the direction of flow may be reversed so that hydraulic fluid will flow from tensioning device 38, through upstream pipe 70 and lower chamber 66, and into downstream pipe 68. Downstream pipe 68 leads directly to the oil portion of air-oil accumulator 72 (shown diagrammatrically in FIG. 3). The direction of flow is dependent on whether tensioning device 38 is extending or retracting to maintain the tension in cable 48.

Valve stem 54 has a reduced diameter shank 74 formed on its upper end which extends through the top of housing 58 and connects to valve actuator 50. A compression spring 60 located in upper chamber 64 surrounds shank 74. Tension in cable 48 pulls upwardly on valve actuator 50 which, in turn, pulls upwardly on shank 74 thereby compressing spring 60. If tension in cable 48 drops below the force in preloaded spring 60, the spring extends rapidly forcing valve stem 54 downwardly until the face 76 of valve stem 54 contacts valve seat 78 thereby shutting off flow in both directions. When this happens the piston of tensioning device 38 may extend slightly since it is unrestrained by tension in cable 48. However, due to the incompressibility of the hydraulic fluid further motion of the piston will be prevented.

In an alternate embodiment air pressure is used to close safety valve 56. Spring 60 is eliminated and upper chamber 64 is connected to an air pressure source. When tension in cable 48 drops below a predetermined level, the air pressure forces valve stem 54 downwardly closing the valve.

Figure 3:
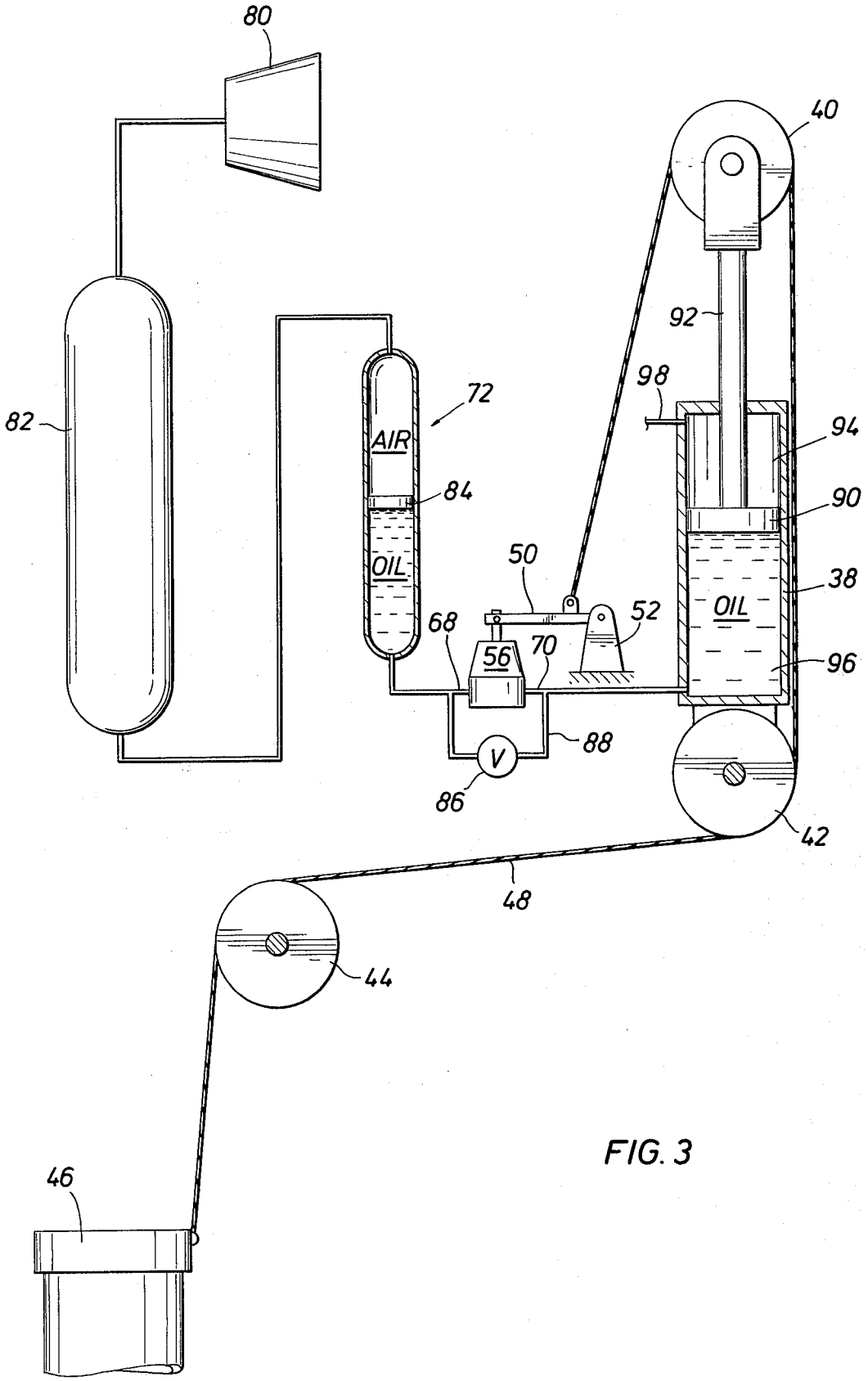
FIG. 3 is a flow diagram of the riser tensioner safety system of the present invention.

FIG. 3 diagrammatically illustrates one embodiment of the riser tensioner safety system of the present invention. The tensioning device 38 contains piston 90 which is attached to piston rod 92. Movable sheave 40 is attached to the top of piston rod 92. Stationary sheave 42 is attached to the bottom of tensioning device 38. The tension cable 48 extends from tension ring 46 which is mounted on outer barrel 28 of the riser 20 over turndown sheave 44, around sheaves 42 and 40, and attaches to valve actuator 50. Pressurized hydraulic fluid is supplied to the bottom of piston 90 by air-oil accumulator 72. The chamber 94 above piston 90 may be filled with a low pressure oil in which case the exhaust 98 would be connected to a low pressure oil reservoir (not shown). Alternatively, chamber 94 may be filled with air. As the vessel heaves upwardly, tension in cable 48 forces piston 90 downwardly which, in turn, forces the high pressure hydraulic fluid out of lower chamber 96 of tensioning device 38 and into the air-oil accumulator 72. Conversely, if the vessel heaves downwardly, air-oil accumulator 72 forces additional hydraulic fluid into lower chamber 96 thereby forcing piston 90 upwardly to maintain tension in cable 48.

An air compressor 80 is used to maintain a preselected pressure in air pressure vessel 82 which may include additional pressure regulation equipment (not shown). The pressure may be as high as 2400 psi. Pressure vessel 82 maintains the air pressure in air-oil accumulator 72. A floating piston 84 is used to separate the pressurized air from the pressurized hydraulic fluid. The hydraulic fluid flows from air-oil accumulator 72, through downstream pipe 68, safety valve 56 and upstream pipe 70, and into tensioning device 38. Alternatively, the hydraulic flow may be reversed. The direction of flow is dependent on whether vessel 10 is heaving up or down.

During start up operations safety valve 56 is closed since there is no tension in cable 48. A by-pass pipeline 88 containing a manually operated valve 86 is used to supply hydraulic fluid to tensioning device 38 during start up. When cable 48 has been tensioned sufficiently to hold safety valve 56 open, manually operated valve 86 is closed. Thereafter all fluid flow to and from tensioning device 38 must pass through safety valve 56.

Due to the high tension in cable 48 it may be advisable to include a mechanical stop (not shown) in the actuator mechanism (see FIG. 2) to prevent valve actuator 50 from damaging safety valve 56. Use of such a device is well known in the art.

The apparatus of the present invention and the best mode contemplated for practicing the invention have been described. It should be understood that the invention is not to be unduly limited to the foregoing which has been set forth for illustrative purposes. Various modifications and alterations of the invention will be apparent to those skilled in the art without departing from the true scope of the invention defined in the following claims. For example, other types of tensioners and other types of valves could be employed. A pneumatic spring tensioner could be used in place of the pneumatic/hydraulic tensioner described above. The valve stem could be directly connected to the tension cable without use of an actuator mechanism. Alternatively, the valve could be remote from the triggering mechanism which, for example, could be an electrical, hydraulic or pneumatic switch which is closed by a reduction of tension in the tensioner cable. Chains could be used in place of wire cables. Further, the tensioner safety system described above would be applicable to the tensioning of other equipment extending from the surface of a body of water to a subsea wallhead such as, for example, a guideline.

What we claim is:

1. A tensioner system for tensioning a marine riser extending between a floating vessel and a wellhead at the bottom of a body of water, said tensioner system comprising:

at least one flexible tensioning line having a first end attached to the top of said riser and a second end attached to a stationary anchor point on said vessel;

tensioning means attached to said vessel, said tensioning means being in contact with and capable of applying force to said flexible tensioning line; and safety means attached to said flexible tensioning line and adapted to deactivate said tensioning means if the tension in said flexible tensioning line drops below a predetermined level, thereby preventing said tensioning means from applying force to said flexible tensioning line.

2. The tensioner system of claim 1 wherein said flexible tensioning line is a wire cable.

3. The tensioner system of claim 1 wherein said flexible tensioning line is a chain.

4. The tensioner system of claim 1 wherein said tensioning means is a pneumatic/hydraulic tensioner cylinder having a hydraulic fluid supply line attached thereto.

5. The tensioner system of claim 4 wherein said safety means is a full-opening valve installed in said hydraulic fluid supply line, said full-opening valve capable of being held open by tension in said flexible tensioning line and rapidly closed if tension drops below a predetermined level.

6. The tensioner system of claim 5 wherein said full-opening valve is a globe valve.

7. The tensioner system of claim 5 wherein said full-opening valve is a gate valve.

8. The tensioner system of claim 5 wherein said full-opening valve is adapted to be closed by a mechanical spring.

9. The tensioner system of claim 1 wherein said tensioning means is a pneumatic spring tensioner cylinder having an air pressure supply line attached thereto.

10. The tensioner system of claim 10 wherein said safety means is a full-opening valve installed in said air pressure supply line, said full opening valve capable of being held open by tension in said flexible tensioning line and rapidly closed if tension drops below a predetermined level.

11. A riser tensioner safety system for tensioning a marine riser extending between a floating vessel and a wellhead at the bottom of a body of water, said riser tensioner safety system comprising:

at least one flexible tensioning line having a first end attached to the top of said marine riser and a second end attached to a stationary anchor point on said vessel;

pneumatic/hydraulic tensioning means attached to said vessel, said pneumatic/hydraulic tensioning means being in contact with and capable of applying force to said flexible tensioning line;

a hydraulic fluid supply line attached to said pneumatic/hydraulic tensioning means; and safety valve means installed in said hydraulic fluid supply line, said valve means capable of being held open by tension in said flexible tensioning line and rapidly closed if tension drops below a predetermined level.

12. The riser tensioner safety system of claim 11 wherein said flexible tensioning line is a wire cable.

13. The riser tensioner safety system of claim 11 wherein said flexible tensioning line is a chain.

14. The riser tensioner safety system of claim 11 wherein said system further comprises a by-pass line having a manually operated valve installed therein, said by-pass line extending around and by-passing said safety valve means whereby hydraulic fluid may be supplied to said pneumatic/hydraulic tensioning means during start up operations.

15. The riser tensioner safety system of claim 11 wherein said safety valve means is a globe valve.

16. The riser tensioner safety system of claim 11 wherein said safety valve means is a gate valve.

17. The riser tensioner safety system of claim 11 wherein said safety valve means is adapted to be closed by a mechanical spring.

* * * * *